United States Patent [19]

Cobb et al.

[11] Patent Number: 4,899,823

[45] Date of Patent: Feb. 13, 1990

[54] METHOD AND APPARATUS FOR RUNNING COILED TUBING IN SUBSEA WELLS

[75] Inventors: Charles C. Cobb, Lewisville, Tex.; Eric R. McK. Ladbrook; Peter Cowan, both of Montrose, Scotland

[73] Assignee: Otis Engineering Corporation, Dallas, Tex.

[21] Appl. No.: 287,039

[22] Filed: Dec. 21, 1988

[30] Foreign Application Priority Data

Sep. 16, 1988 [GB] United Kingdom ..... 8821713

[51] Int. Cl.[4] ..... E21B 41/06

[52] U.S. Cl. ..... 166/351; 166/77; 166/356; 166/360

[58] Field of Search ..... 166/77, 355, 338, 351, 166/356, 360, 368, 378, 381, 384

[56] References Cited

U.S. PATENT DOCUMENTS

| | | | |
|---|---|---|---|
| 2,567,009 | 9/1951 | Calhoun et al. | 166/77 |
| 3,285,485 | 11/1966 | Slator | 166/77 |
| 3,313,346 | 4/1967 | Cross | 166/77 |
| 3,415,317 | 12/1968 | Drivet | 166/77 |
| 3,517,736 | 6/1970 | Waldron | 166/77 |
| 3,690,381 | 9/1972 | Slator et al. | 166/86 |
| 3,827,487 | 8/1974 | Jackson et al. | 166/77 |
| 3,866,679 | 2/1975 | Laky | 166/77 |
| 3,920,076 | 11/1975 | Laky | 166/77 |
| 4,258,794 | 3/1981 | Sizer et al. | 166/356 |
| 4,417,624 | 11/1983 | Gockel | 166/77 |
| 4,577,693 | 3/1986 | Graser | 166/338 |
| 4,621,403 | 11/1986 | Babb et al. | 166/77 |

*Primary Examiner*—Bruce M. Kisliuk
*Attorney, Agent, or Firm*—M. H. Gay

[57] ABSTRACT

A method and apparatus for injecting coiled tubing into a submerged well. The end of a coiled tubing is latched in a tubing injector and the tubing and injector are lowered through a body of water together. The injector is latched to the well and the injector moves the coiled tubing through the well. The injector weight is exerted on the tubing during movement through the body of water.

The injector may be contained in a bell type or complete enclosure and fluid in the enclosure is maintained at approximately the external pressure.

The injector may be connected to a shear, a stuffing box, and a tool receiver.

15 Claims, 3 Drawing Sheets

METHOD AND APPARATUS FOR RUNNING COILED TUBING IN SUBSEA WELLS

This invention relates to method and apparatus for running coiled tubing in subsea wells whose wellheads are located on or near the ocean floor. Production lines from such wells usually extend along the ocean floor.

In the maintenance and servicing of subsea wells several systems have been used. Tools have been pumped through the production lines in one well known procedure. In servicing from vessels, wire line procedures have been used. See U.S. Pat. No. 4,673,041. Another well known procedure has involved the erection of a riser pipe on the well. Recently flexible pipe and systems have been developed. See U.S. Pat. Nos. 4,702,320 and 4,730,677.

Each of these prior art systems has its advantages and disadvantages.

One well known system for servicing wells on land has involved the use of coiled tubing which is forced into a well by a tubing injector. This equipment makes possible the injection of fluid and the use of a well tool on the tubing. See U.S. Pat. No. 4,612,984. Tubing injectors have also been used in the same manner on offshore platforms where the wellhead is located on the platform adjacent the surface of the water and the injector is located on the platform.

An object of this invention is to provide a simple, relatively inexpensive apparatus and method of using coiled tubing in subsea wells.

Another object is to provide for using coiled tubing in subsea wells in which the tubing injector is positioned on the subsea wellhead.

Another object is to provide for using coiled tubing in subsea wells in which the tubing injector and tubing are run simultaneously, with the tubing latched in the tubing injector, and the tubing injector landed on and latched to the wellhead.

Another object is to provide for using coiled tubing in subsea wells as in the preceding object in which a tubing shear is provided on top of the tubing injector to provide for emergency release of the tubing from the tubing injector.

Another object is to provide for using coiled tubing in subsea wells in which the tubing injector and a tubing carrying a well tool are simultaneously run with the tubing latched in the tubing injector and the tubing injector landed on and latched to the wellhead.

Another object is to provide for using coiled tubing in subsea wells as in the preceding objects in which a well fluid stuffing box is carried by the tubing injector with the tubing in the stuffing box during running.

Another object is to provide for using coiled tubing in subsea wells in which the tubing and tubing injector are run simultaneously, with the tubing latched in the tubing injector, and the weight of the tubing injector is used to unreel the coiled tubing.

Another object is to provide for using coiled tubing in subsea wells in which during retrieval of the tubing it is latched to the tubing injector and the weight of the injector is used to maintain the tubing in tension during the retrieval operation.

Another object is to provide a subsea tubing injector within an enclosure to prevent sea water from contacting the tubing injector in which provision is made to maintain the enclosure under pressure approximating external pressure.

Another object is to provide a subsea tubing injector with an open bottom bell type enclosure or a fluid tight enclosure and to maintain a selected fluid in the enclosure under pressure.

Other objects features and advantages of this invention will be apparent from the drawings, specification and claims. In the drawings, wherein like numerals indicate like parts and wherein an illustrative embodiment of this invention is shown:

Figure 3:
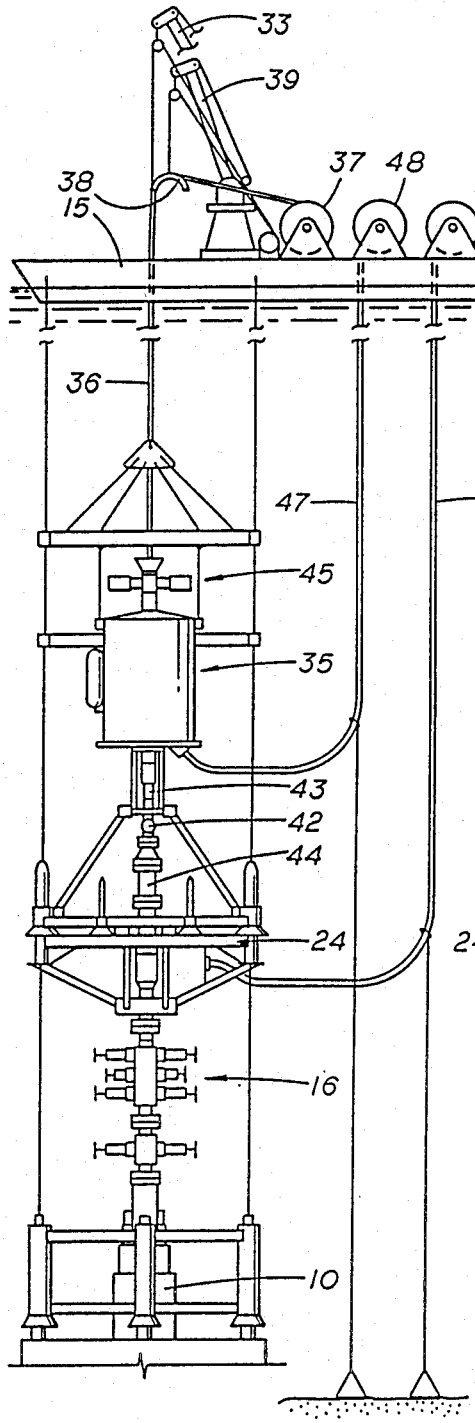
FIG. 3 is a view similar to FIG. 2 showing the tubing injector landed and latched onto the wellhead.
Figure 4:
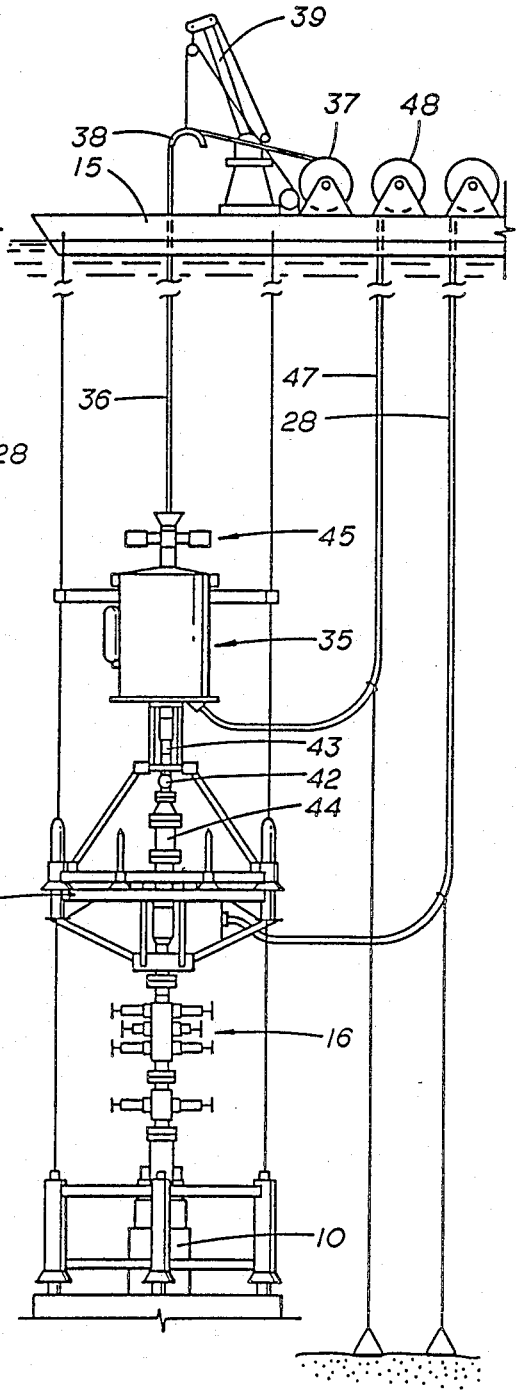
Figure 5:
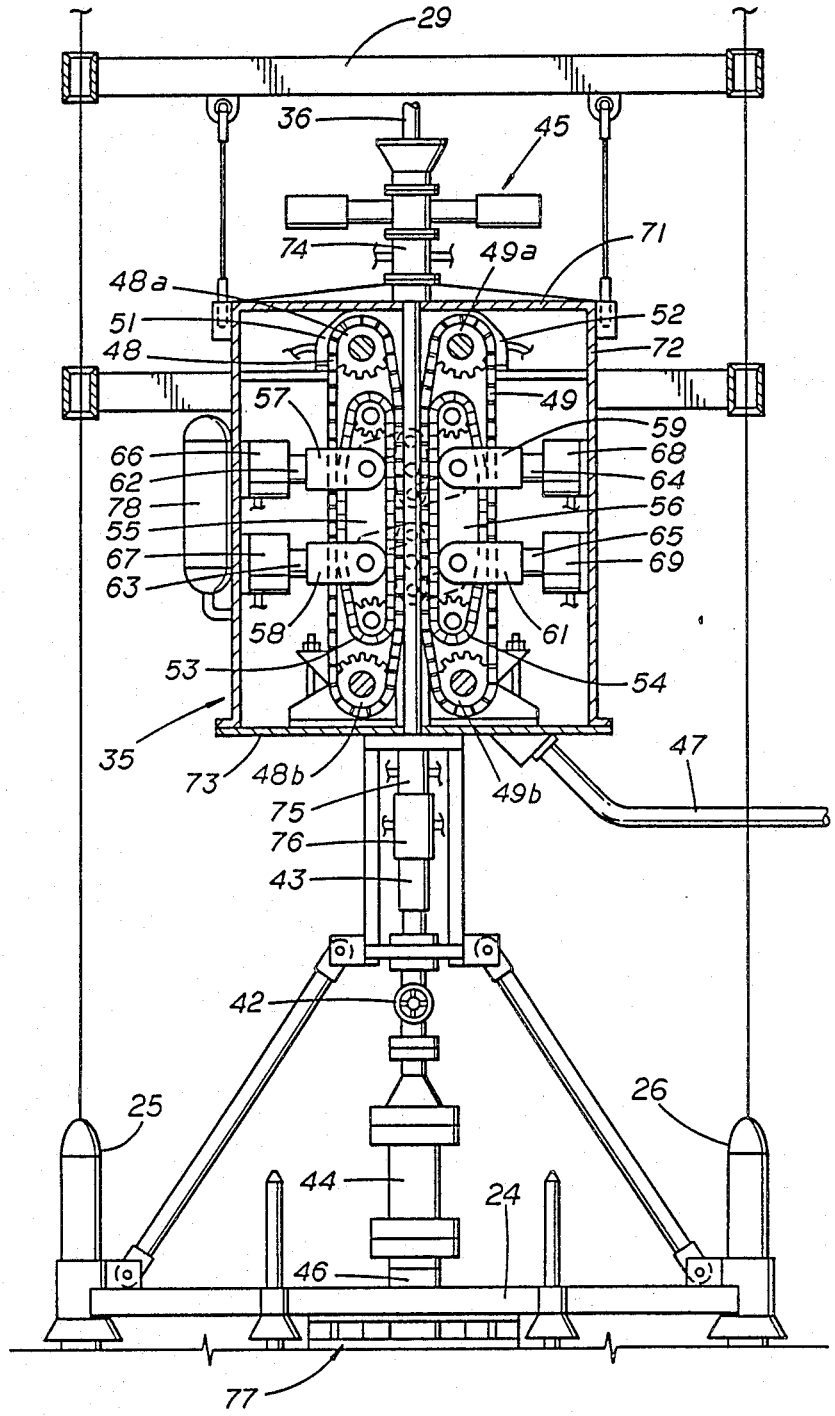

FIG. 4 is a view similar to FIG. 3 showing the coiled tubing being used in servicing the well; and FIG. 5 is a view partly in elevation and partly in section illustrating a tubing injector and associated equipment for practicing this invention. In accordance with this invention the tubing injector is positioned on the subsea wellhead and injects or retracts tubing as needed. The reel on the surface vessel may maintain the tubing in tension and pay out or reel in tubing as needed.

To position the tubing injector on the wellhead, the tubing is first positioned in the injector and latched in place. Then the injector is lowered through the body of water. The weight of the injector assembly is utilized to pull the tubing from the reel while the reel maintains the tubing in tension by resisting rotation.

The injector assembly is guided to the wellhead in any desired manner and when landed is latched to the wellhead. Preferably a blowout preventer stack has previously been landed on the wellhead and the injector assembly is landed on the stack.

It is further preferred that a well fluid stuffing box be carried by the injector and that the tubing extend into and preferably through the box during running of the assembly.

If a well tool is carried by the tubing it is further preferred that a tool receiver be provided for the well tool.

During running and retrieving of the injector the tubing may be latched in the injector in any desired manner. For instance the endless chains of the injector may be locked against movement and held in engagement with the tubing.

During retrieval of the injector the weight of the injector assembly is utilized to maintain the tubing in tension as it is coiled on the reel.

It is preferred that the injector be contained within an environmental enclosure. This may be a bell type or a fluid tight enclosure. With a bell type, the bottom of the enclosure is open and a gas such as nitrogen is maintained under pressure in the bell to exclude sea water. The gas should be maintained at approximately the same pressure as that exterior of the bell to exclude sea water. If desired a barrier fluid such as oil may be maintained in the bottom of the bell to inhibit movement of sea water vapor into the bell.

When a fluid tight enclosure is employed a suitable fluid may be maintained in the enclosure, preferably at a pressure approximating exterior pressure to avoid an undesirable differential across the enclosure wall. Preferably the fluid is maintained at a pressure slightly above the surrounding pressure to insure that sea water cannot invade the enclosure.

When an environmentally objectionable fluid such as oil is used in the enclosure, means should be provided to prevent loss of such fluid into the sea.

To provide for emergency release from the well a tubing shear may be provided, preferably on top of the injector.

Figure 1:
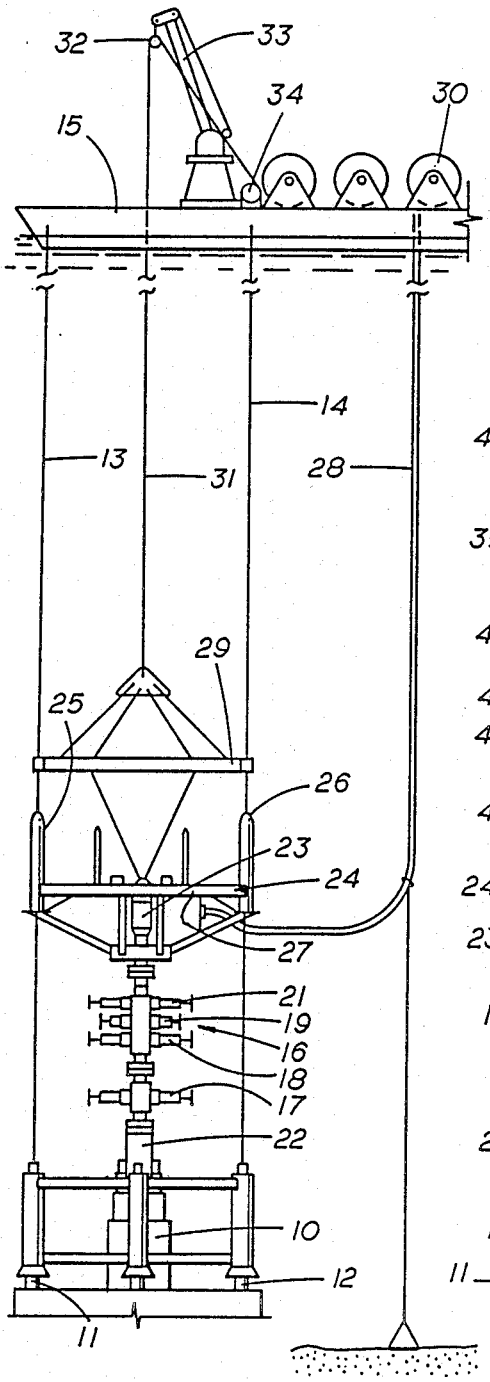
FIG. 1 is a schematic illustration of a blowout preventer stack and lower latch assembly being run from a surface vessel and landed on a subsea wellhead.
Figure 2:
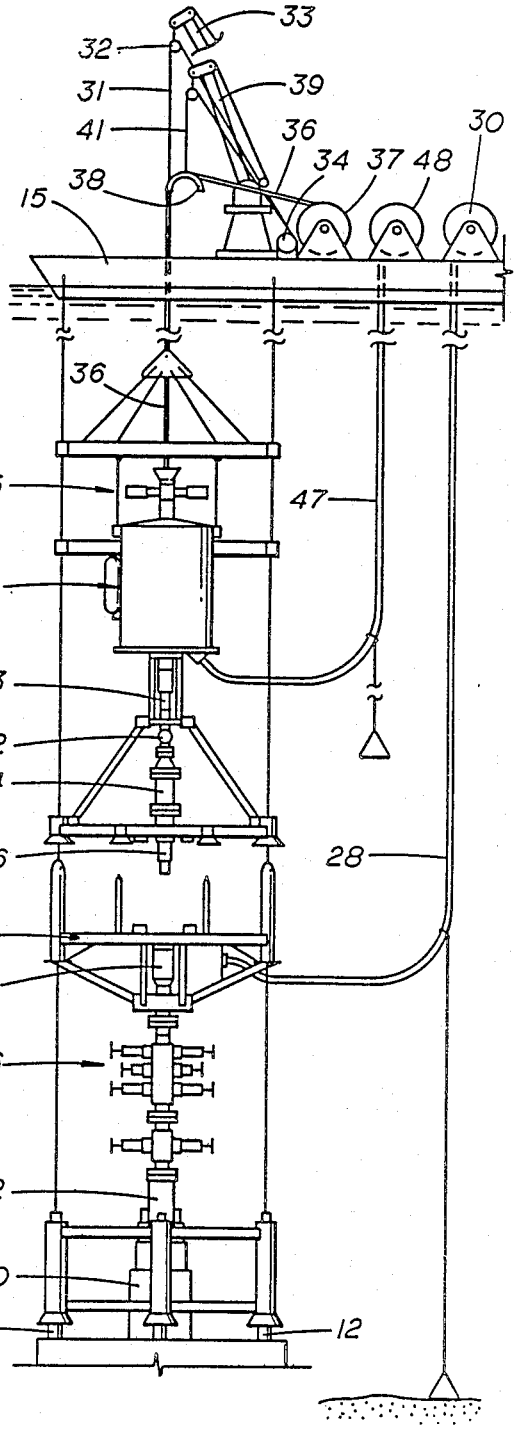
FIG. 2 is a view similar to FIG. 1 showing the coiled tubing and tubing injector and associated equipment being run on the wellhead of FIG. 1.

In FIG. 1 a wellhead 10 has guide post 11 & 12 from which guide wires 13 and 14 extend to the surface vessel 15.

A blowout preventer stack and associated structure, indicated generally at 16, is shown landed on the wellhead. The structure 16 includes the blowout preventers 17, 18, 19 & 21. A lower latch 22 secures the structure to the wellhead. Above the stack is the lower section 23 of a latch structure for latching the injector to the wellhead. A lower guide frame, indicated generally at 24, is carried on the stack and includes guide post 25 & 26 slidable on guide wires 13 & 14. The guide frame includes the connector bulkhead 27 and the lower stack control umbilical 28 which supplies power for any desired equipment such as the several blowout preventers, latches, etc. The blowout preventer stack may be considered a part of the wellhead.

The umbilical 28 is carried on a reel 30 which is operated to control the umbilical as the stack structure is run or retrieved.

The stack structure 16 is suspended from the lift beam 29 which is in turn suspended by cable 31 which is trained over sheave 32 on arm 33 and wound on reel 34.

The above described assembly is lowered by paying out cable 31 from reel 34 and then landed on the wellhead 10 and latched in place by latch 22. Motion compensation may be provided in any desired manner.

Thereafter a coiled tubing injector, indicated generally at 35 is suspended from the lift beam and a coiled tubing 36 is introduced into the injector. Coiled tubing injectors are well known and an injector such as taught in U.S. Pat. No. 4,655,291 to Cox may be employed. As collars will not be present on the coiled tubing the lower pressure beams 74 & 75, shown in U.S. Pat. No. 4,655,291, may be omitted and the chains 28 and **28*a* shortened if desired as shown in FIG. 5**.

The coiled tubing 36 extends from reel 37 over the sheave structure 38 and then downwardly into the injector. The sheave structure 38 is supported on arm 39 by line 41. Motion compensation may be provided in any desired manner.

The tubing 36 is latched in the injector in any desired manner. For instance the endless chains of the injector may be locked against movement and held firmly against the tubing to latch the tubing in the injector. Other latch structures may be used.

It is further preferred that a well fluid stuffing box 43 be carried by the injector and that prior to lowering the tubing also be positioned in the stuffing box. In the illustrated embodiment the blowout preventer 42 is positioned below the stuffing box and a tool receiver provided by a spool 44 and/or the upper latch section 46 is carried below the blowout preventer. It is preferred that when a tool is carried by the tubing that the tubing extend through the stuffing box and blowout preventer and that the well tool be positioned in the tool receiver. The blow out preventer may be closed to change packing in the stuffing box.

It is further preferred that a tubing shear, indicated generally at 45, be included with the injector. As shown the shear is preferably mounted on top of the injector and when operated separates the tubing above the injector. The shear 45 is preferably operated by fluid pressure from umbilical 28.

A suitable upper latch section 46, designed to cooperate with latch section 23 on the blowout preventer stack 16, depends from the spool 44 and when the injector and its associated structure is landed the latch sections 23 and 46 cooperate to latch the injector to the well head through the blowout preventer stack.

With the injector and associated structure latched to the tubing, the injector is lowered to the wellhead and during lowering the weight of the injector is utilized to unreel tubing from reel 37. Reel 37 is operated to maintain the tubing in tension during the lowering operation. Thus the tubing is maintained under control and any effect of currents is minimized.

An injector control umbilical 47 is unreeled from reel 48 as the injector is lowered and supplies power to the injector. For instance, the injector may be operated by hydraulic fluid supplied by umbilical 47.

After the injector is landed and latched in place the injector may be operated to move tubing through the wellhead. Preferably the reel 34 will maintain the tubing in tension at all times. Fluid may be injected and any tool on the tubing may be operated in the conventional manner to service the well.

As shown in FIG. 4 the lift beam may be released from the injector and retrieved separately.

When it is desired to retrieve the injector it is operated to withdraw the tubing from the wellhead. If a well tool is employed, it is drawn into the tool receiver.

The lift beam is again attached to the injector and the latch is released to permit separation of the injector from the blowout preventer stack. The cable 31 is taken in to lift the injector and associated equipment. The tubing reel 37 is operated to maintain the tubing in tension to insure control of the tubing and proper spooling of the tubing on the reel. Thus the weight of the injector and associated equipment is utilized to maintain the tubing in tension.

In FIG. 5 a form of injector following the teaching of U.S. Pat. No. 4,655,291 is shown. As any desired form of coiled tubing injector may be employed, reference is made to this patent for a teaching of a suitable injector.

The injector includes a pair of opposed endless drive chains 48 and 49 driven by motors 51 and 52. The chain 48 is trained over drive sprocket **48*a* and idle sprocket 48*b*. The chain 49 is trained over drive sprocket 49*a* and idler sprocket 49*b*. These motors may be powered in any desired manner, such as by hydraulic fluid from umbilical 47. A pair of opposed endless roller chains 53, 54 hold the drive chains firmly in engagement with the tubing 36. These roller chains are carried by pressure beams 55 and 56. The pressure beams are supported on yokes 57, 58, 59, and 61 which in turn are carried on rods 62, 63, 64, and 65. These rods are on pistons (not shown) in cylinders 66, 67, 68, and 69. By controlling pressure fluid in these cylinders through the umbilical 47** the pressure exerted by the roller chains on the drive chains is controlled. If desired, one of the pressure beams may be fixed and adjusted by screws.

By holding the drive motors locked against rotation with hydraulic pressure and holding the roller chains firmly against the drive chains the injector may be locked to the tubing during running and retrieval of the injector. After the injector is landed, rotation of the drive chains will inject or retrieve pipe from the well.

Preferably the injector is not exposed to sea water. This may be accomplished with the diving bell concept or with a total enclosure. In either event the enclosure will include a top 71 and a complete side wall, such as the cylindrical side wall 72 shown. With the bell concept the bottom of the enclosure is open and sea water is excluded by pressure fluid, preferably nitrogen, maintained under sufficient pressure to exclude sea water from the injector. Where the complete enclosure concept is employed a bottom 73 is provided. The enclosure may be filled with a fluid under pressure to equalize pressure with the exterior. In this case, upper and lower tubing strippers 74 and 75 are provide about the tubing 36 at the top and bottom of the enclosure. With the bell concept the upper stripper is also used. If the strippers leak fluid, provision should be make to prevent this fluid escaping into the sea if it is environmentally objectionable. For instance, oil might fill the enclosure to lubricate the injector. In this event, the fluid in the enclosure would be maintained under pressure greater than exterior pressure to prevent sea water entering the enclosure through the strippers.

As there may be some escape of fluid from the well through the stuffing box 43 it is preferred that a ported coupling 76 be provided between the stuffing box and stripper 75 to permit disposal of this fluid when utilizing the fluid tight enclosure. With the bell type enclosure the ported coupling is not needed.

The hydraulic connector bulkhead 77 receives control fluid from the umbilical 28 and distributes it to the various motors as desired through conduits not shown.

An emergency supply of pressure may be provided by the tank 78.

In the use of the injector shown in FIG. 5 the injector is suspended from the bar 29. The pressure beams 55 and 56 are positioned to permit the drive chains to receive the tubing and the tubing is positioned between the drive chains. Preferably the tubing extends down past the blowout preventer and stuffing box. If a tool is to be employed it is position in the tool receiver. The pressure beams are positioned to hold the drive chains against the tubing. The drive chains are locked in place.

The injector may then be lowered from the vessel to the well head while paying out tubing from the reel 37 and while maintaining the tubing in tension. Upon landing the injector and latching it to the well, the injector may be operated in the conventional manner to move the tubing through the well head, operate tools, etc.

When it is desired to retrieve the injector, it is first operated to withdraw the tubing from the well head. The latch is then released. With the drive chains locked to the tubing the tubing is reeled on reel 37. The injector is lifted by the lift beam 29 while the reel 37 maintains the tubing in tension to insure proper spooling of the tubing on the reel.

The foregoing disclosure and description of the invention are illustrative and explanatory thereof and various changes in the method and system and in the size, shape and materials, as well as in the details of the illustrated construction, may be made within the scope of the claims without departing from the spirit of the invention.

What is claimed is:

1. The method of introducing a well tubing into a subsea well comprising;

positioning the free end of a tubing coiled on a reel in a tubing injector, latching the tubing in the tubing injector, lowering the injector through a body of water from the surface to a wellhead on the bed of the body of water while paying out tubing from the reel and maintaining the tubing latched in the injector, connecting the tubing injector to said wellhead, and operating said injector to feed tubing through said wellhead.

2. The method of claim 1 wherein during the lowering step the weight of the tubing injector is utilized to pull tubing from the reel.

3. The method of claim 1 wherein an enclosure having at least a top and side walls is provided and contains said tubing injector, and a selected fluid is maintained in said enclosure at a pressure approximating that of the surrounding water while said enclosure is positioned in the body of water.

4. The method of claim 1 wherein a well fluid stuffing box is carried by the tubing injector and during the positioning step the tubing is positioned in the stuffing box.

5. The method of claim 1 wherein during recovery of the tubing and tubing injector;

the tubing injector is first operated to withdraw the tubing from the wellhead, the tubing injector is unlatched from the wellhead, the tubing is latched in the tubing injector, and while the reel is operated to reel in the tubing the weight of the tubing injector is utilized to maintain the tubing in tension.

6. The method of introducing a coiled tubing and well tool into a subsea well comprising, assembling a tool receiver and tubing injector with the receiver below the injector, positioning the free end of a coiled tubing in the injector and a well tool on the free end of the coiled tubing in the tool receiver, simultaneously lowering the coiled tubing and well tool and assembly from the surface of a body of water to a wellhead on the bed of the body of water while maintaining said well tool in said tool receiver, connecting said tool receiver to said wellhead, and operating said injector to insert said well tool and coiled tubing into the well through said wellhead.

7. The method of claim 6 wherein during the assembling step a well fluid stuffing box is assembled between the injector and tool receiver, and during the positioning step the coiled tubing is positioned in the stuffing box.

8. The method of claim 6 wherein during the assembling step a blowout preventer is included in the assembly.

9. The method of introducing a coiled tubing and well tool into a subsea well comprising;

assembling a tubing injector in an enclosure which includes a top and side wall and a tubing stripper at its upper end, a stuffing box, and a tool receiver with the stuffing box positioned between the tool receiver and the injector;

positioning a coiled tubing in the injector, tubing stripper, and stuffing box, and positioning a well tool on the coiled tubing in the tool receiver;

simultaneously lowering the coiled tubing and well tool and assembly from the surface of a body of water to a wellhead on the bed of the body of water while maintaining said well tool in said tool receiver;

connecting said tool receiver to said wellhead;

operating said injector to insert said well tool and coiled tubing into the well through said wellhead; and maintaining the interior of said enclosure under pressure while in said body of water.

10. The method of claim 9 wherein the interior pressure of said enclosure is maintained at least at approximately the pressure exterior of said enclosure.

11. The method of claim 9 wherein the interior of said enclosure is filled with a liquid and maintained at least at approximately the pressure exterior of said enclosure.

12. The method of claim 9 wherein a tubing shear is provided above the tubing injector, and during an emergency the shear is operated to sever the coiled tubing and release it from the tubing injector.

13. A well assembly for servicing subsea wells comprising:

an enclosure including a top and side walls for excluding sea water;

a tubing injector in said enclosure for moving reeled tubing through the injector;

said injector including opposed endless chains for gripping reeled tubing, and means for controlling movement of said chains;

means for maintaining selected pressure conditions in said enclosure to maintain pressure therein substantially equal to exterior pressure to exclude sea water and protect said injector; and a shear positioned above the tubing injector.

14. A well assembly for servicing subsea wells comprising:

an enclosure including a top and side walls for excluding sea water;

a tubing injector in said enclosure for moving reeled tubing through the injector;

said injector including opposed endless chains for gripping reeled tubing, and means for controlling movement of said chains;

means for maintaining selected pressure conditions in said enclosure to maintain pressure therein substantially equal to exterior pressure to exclude sea water and protect said injector;

said top having an opening therethrough;

a stripper on said top overlying said opening for receiving tubing, means on said stripper for recovering fluid escaping between the stripper and a tubing therein;

a well fluid stuffing box carried below the enclosure;

a tool receiver carried below the stuffing box; and latch means carried below the tool receiver for latching the tool receiver to a wellhead.

15. The assembly of claim 14 wherein a bottom is provided in said enclosure with an opening therein;

a stripper is provided on said bottom underlying said bottom opening for receiving tubing; and means are provided for recovering fluid escaping between the stripper and a tubing therein, and between the stuffing box and a tubing therein.

* * * * *